United States Patent [19]

Truluck

[11] 4,416,095

[45] Nov. 22, 1983

[54] SUPPORT HANGER KIT FOR SUSPENSION CEILINGS AND METHOD OF INSTALLATION

[76] Inventor: Donovan Truluck, 313 Almeda Pkwy., Arnold, Md. 21012

[21] Appl. No.: 298,363

[22] Filed: Sep. 1, 1981

[51] Int. Cl.[3] ..... E04B 5/52

[52] U.S. Cl. ..... 52/173 R; 52/127.5; 52/741; 52/749

[58] Field of Search ..... 52/127.1, 127.5, 173, 52/484, 741, 749, 750, 486

[56] References Cited

U.S. PATENT DOCUMENTS

| | | | |
|---|---|---|---|
| 3,791,094 | 2/1974 | Shannon | 52/749 X |
| 3,802,149 | 4/1974 | Armstrong | 52/749 X |
| 3,859.770 | 1/1975 | Chambers et al. | 52/127.5 X |
| 3,998,332 | 12/1976 | Lambertson | 211/13 |
| 4,027,802 | 6/1977 | Reynolds | 52/749 X |
| 4,041,668 | 8/1977 | Jahn et al. | 52/484 X |
| 4,084,364 | 4/1978 | Jones | 52/484 |
| 4,089,146 | 5/1978 | Martinez | 52/484 |
| 4,280,312 | 7/1981 | Otts | 52/749 |

*Primary Examiner*—J. Karl Bell

*Attorney, Agent, or Firm*—Charles W. Helzer

[57] ABSTRACT

A new and improved support hanger for suspended ceilings is described along with a method of its use in installation of suspended ceilings between sets of parallel ceiling joists. The support hanger has a generally U-shaped configuration with the free ends thereof bent outwardly away from each other and downwardly towards the bottom of the U-shaped bend to form two hooked ends which open downwardly and lie in substantially the same plane with the U-shaped bend. The hanger is employed in erecting a suspended ceiling by tying a suspension wire to be supported in space between a set of parallel ceiling joists to the support hanger. The U-shaped bend portion of the support hanger is then inserted together with attached suspension wire in a keyway formed in the end of an elongated pole of sufficient length to reach between the parallel ceiling joists from the floor of the building space.

18 Claims, 5 Drawing Figures

SUPPORT HANGER KIT FOR SUSPENSION CEILINGS AND METHOD OF INSTALLATION

TECHNICAL FIELD OF INVENTION

This invention relates to a new and improved support hanger for suspended ceilings together with a kit and method of installing suspension ceilings using the support hanger.

More specifically, the invention relates to a new labor-saving support hanger for suspended ceilings which does not require that workmen climb up to the level of the roof joists of a building in which suspended ceilings are being installed in order to individually tie each suspension wire for the suspended ceiling to the roof joists.

BACKGROUND PROBLEM

In commercial and industrial buildings now being constructed in the United States, most designs employ suspended ceilings which are suspended from parallel sets of roof joists which run across the width of the building just below the roof. These parallel sets of roof joists may comprise steel rods which are spaced apart about one inch or less and are of one-half inch diameter or greater. The parallel sets of roof joists are spaced along and below the width of the roof at preset intervals and provide a means for securing suspension wires for suspended ceilings which generally are suspended some distance below the roof joists. Current construction techniques require that a workman using a ladder or scaffolding climb up to the level of the roof joists to individually twist around one of the roof joists a suspension wire at predetermined spaced apart intervals along the length of one of the roof joist bars in each set as well as along bars in adjacent sets. This is a labor consuming and expensive, tedious and sometime dangerous job which adds considerably to the cost of installing suspended ceilings. In order to eliminate the need for such labor consuming, expensive and dangerous procedures, the present invention was devised.

SUMMARY OF INVENTION

It is therefore a primary purpose of the present invention to provide a new and improved support hanger kit for installing suspension wires for suspended ceilings and the like from the roof joists of commercial and other buildings and the method of installation of suspended ceilings using a novel support hanger kit.

In practicing the invention a new and improved support hanger for suspended ceilings and method of installation of suspended ceilings suspension wires between a set of parallel ceiling joists is provided. The new and improved support hanger has a generally U-shaped configuration that provides a generally U-shaped bend portion with the free ends thereof bent outwardly away from each other and downwardly towards the bottom of the U-shaped bend portion to form two hooked ends which open downwardly and lie in substantially the same plane with the U-shaped bend portion. The method of installation of suspended ceiling suspension wire employing the support hanger comprises tying a suspension wire to be supported in space between a set of parallel ceiling joists near the U-shaped bend portion of the support hanger. The U-shaped bend portion of the support hanger is then inserted together with the attached suspension wire in a keyway formed in the end of an elongated pole of sufficient length to reach between the parallel ceiling joists from the floor of the building. The keyway in the end of the elongated pole provides a press fit for the support hanger U-shaped bend portion and prevents relative rotation between the inserted support hanger and the pole. With the support hanger and attached suspension wire inserted, the end of the elongated pole is raised through the space between a set of closely spaced-apart parallel ceiling joists by orientating the pole and support hanger insert so that the plane containing the downwardly directed hooked ends is parallel to the axes of the set of parallel ceiling joists. The end of the pole together with the inserted support hanger is then raised sufficiently above the level of the parallel ceiling joists so that the support hanger hooked ends will clear the tops of the ceiling joists. The elongated pole is then rotated together with the inserted support hanger relative to the set of ceiling joists so that the plane containing the downwardly directed hooked ends is substantially at right angles with respect to the longitudinal axes of the set of parallel ceiling joists. The end of the pole with the inserted support hanger is then lowered with the support hanger thus oriented to cause the downwardly directed hooked ends of the support hangers to engage the tops of the ceiling joists. The end of the pole is then tugged downwardly with sufficient force to release the support hanger from its press fit in the keyway and leaves the support hanger together with its attached suspension wire at a desired point in space along the length of the ceiling joist.

In preferred forms of the invention, the support hanger is comprised of hevy gauge galvanized wire bent to provide the generally U-shaped configuration with the downwardly directed hooked end portions. The elongated pole can comprise a length of electrical conduit having a solid plug closing one end with the solid plug having a keyway formed therein for receiving the U-shaped bend portion of the support hanger. Alternatively, the elongated pole can comprise a telescoping pole which can be telescoped out to reach different height ceiling joists and has a solid plug closing the end of the outermost telescoping section with the solid plug having a keyway formed therein for receiving the U-shaped bend portion of the support hanger. Installation kits including such an elongated pole together with the new and improved support hanger comprise a part of the subject invention.

The suspended ceiling installation method comprising a part of the present invention further includes installing a plurality of support hangers together with respective attached ceiling suspension wires at a number of points along the same and adjacent sets of parallel ceiling joists, securing the ceiling support members to the suspended ends of the ceiling suspension wires at the desired level for the suspended ceiling and thereafter supporting the ceiling panels within the ceiling support members thus secured in space at the desired ceiling level.

BRIEF DESCRIPTION OF THE DRAWINGS

These and other objects and many of the attendant features of the invention will become better understood upon a reading of the following detailed description when considered in conjunction with the accompanying drawings wherein like parts in each of the several figures are identified by the same reference character, and wherein.

BEST MODE OF PRACTICING THE INVENTION

Figure 1:
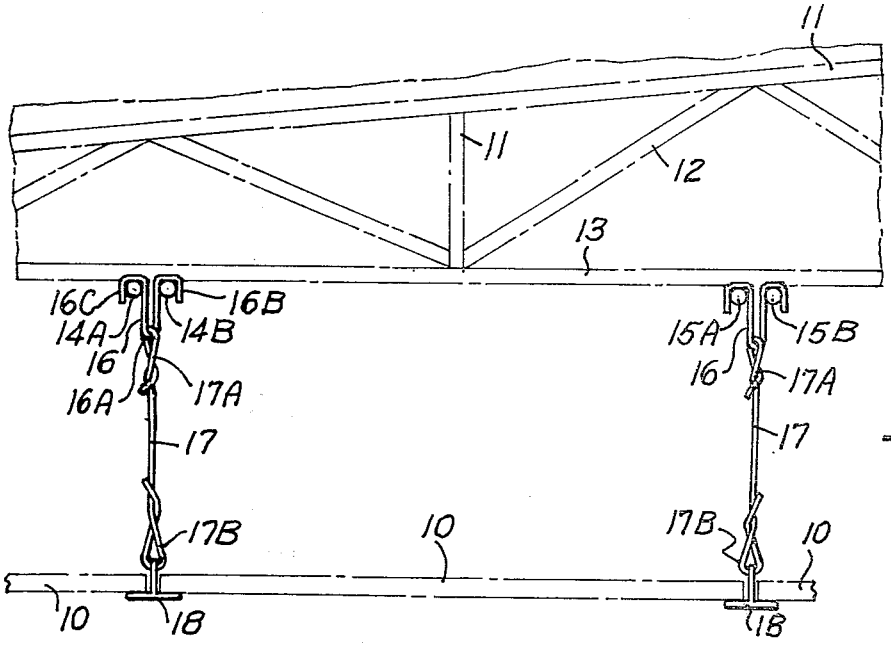
FIG. 1 is a fragmentary elevational view showing the hanger of the present invention installed on the roof structure of a building supported a suspended ceiling, the roof structure and ceiling being shown in phantom lines for purposes of clarity.

FIG. 1 is a fragmentary, side elevational view of the roof structure of a building having a suspended ceiling shown at 10. The roof structure is comprised by a roof 11 supported on interconnected vertical frame members 11, diagonal frame members 12 and horizontally extending frame members 13 forming a roof truss in a well-known manner. The roof structure thus comprised is supported above a ground floor level (not shown) by suitable pillars, columns, or other upright support members (not shown). At spaced apart intervals of about 10–12 feet apart and extending into the plane of the drawings are a series of sets of parallel ceiling joists shown at 14A, 14B and 15A, 15B, etc. In the roof structure shown in FIG. 1, these sets of ceiling joists are circular rods of about ¾ of an inch diameter spaced apart a distance of about 1 inch or less. The ceiling joists extend between the sides of the building underneath the truss framework 11–13 of roof 11 to help support the roof. Depending upon the intended use of the building, or a part thereof, conventionally, the suspended ceiling shown in section at 10 is suspended below the roof truss framework by tying suspension wires such as shown at 17 around the ceiling joists at selected spaced-along points along the length of the sets of ceiling joists with the lower end of the suspension wire 17 being tied through an opening in a ceiling support member such as shown at 18 having a T-shaped cross sectional configuration. The ceiling panels 10 are then secured in the cross bars of the T-shaped support members 18 in the manner illustrated in FIG. 1 .

Conventional construction practice for suspension ceilings requires that a workman climb up on a ladder, scaffold or other means to individually tie each suspension wire 17 around the ceiling joist 14A or 14B, 15A or 15B at desired points along the length of the ceiling joists. This is a tedious, labor consuming and somewhat dangerous job in that it requires the workman to work at the higher elevations of the ceiling joints. To obviate this procedure, the present invention was developed.

Figure 5:
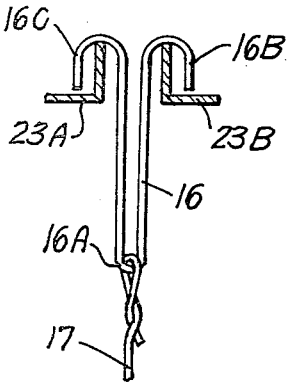
FIG. 5 is an elevational view of the new and improved support hanger according to the invention, shown partly in section, and illustrates its use in conjunction with an alternative form of ceiling joists employing angle bars having L-shaped cross sectional configurations.

FIG. 1 illustrates a suspended ceiling constructed in accordance with the present invention and which utilizes a new and improved support hanger 16 for supporting the suspension wires 17 to which the T-shaped ceiling support members 18 are tied. The support hangers 16, as best shown in FIGS. 2 and 5 of the drawing have a generally U-shaped configuration that provides a generally U-shaped bend portion 16A with the free ends thereof bent outwardly away from each other and downwardly towards the bottom of the U-shaped bend portion to form two hooked ends 16B and 16C which open downwardly in the direction of the U-shaped bend portion 16A and lie in substantially the same plane with the U-shaped bend portion 16A.

Figure 2:
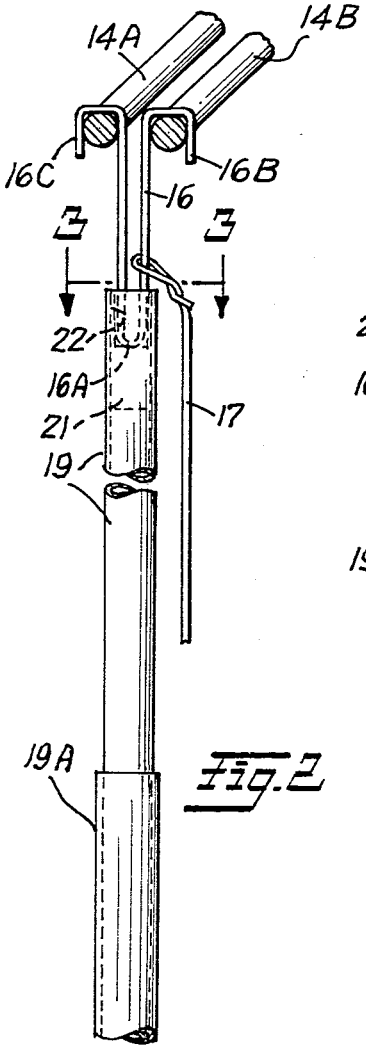
FIG. 2 is a fragmentary elevational view, partly in section, showing a hand tool in the form of an elongated pole for attaching the hanger in place on the ceiling joists of the roof structure.
Figure 3:
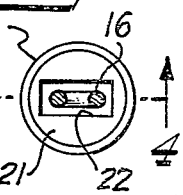
FIG. 3 is an enlarged horizontal, cross sectional view taken through plane 3—3 of FIG. 2, and illustrates the plugged and closed end of the elongated pole shown in FIG. 2 with the plugged end having a keyway formed therein for receiving a support hanger according to the invention.
Figure 4:
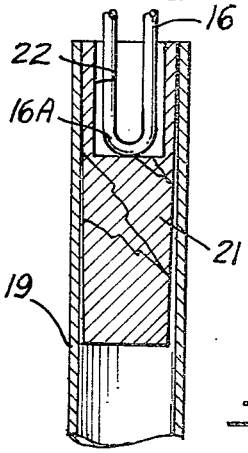
FIG. 4 is a fragmentary, vertical sectional view taken through plane 4—4 of FIG. 3 and shows the details of the keyway formed in the plugged end of the elongated pole hand tool of FIG. 2.

In erecting a suspended ceiling according to the invention, a workmen inserts the support member 16A in the end of an elongated pole shown at 19 in FIG. 2. The elongated pole preferably comprises a telescoping pole having a plurality of different telescoping sections such as 19, 19A that can be telescoped outwardly to provide a pole of any desired length sufficient to reach above the height of the ceiling joists 14A, 14B or 15A, 15B, etc. from the floor of the building. In one end of the elongated pole 19 a solid plug 21 is inserted in the manner of a stopper and has formed in the end thereof a keyway 22 whose configuration is best seen in FIGS. 3 and 4 of the drawings. The keyway 22 is designed to provide a press fit for the generally U-shaped support hanger 16, U-shaped bend portion 16A as best seen in FIG. 4 of the drawings. When thus inserted in the keyway in the end of the elongated pole 19, relative rotation between the pole 19 and the inserted U-shaped support hanger 16 is prevented. At this point in the operation, or prior to inserting the support hanger 16 in the keyway 22, a suspension wire 17 is twisted on to one of the legs of the U-shaped support hanger 16 in the manner shown in FIG. 2 of the drawings.

With the suspension wire 17 twisted on the support hanger 16 and the support hanger 16 inserted and held by press fit in the keyway 22 in the end of elongated pole 19, the workmen is now ready to mount the support hanger 16 on the ceiling joists 14A, 14B or 15A, 15b, etc. To do this, the workman orients the pole 19 together with the inserted support member 16 so that the plane containing the hooked ends 16C and 16B of support hanger 16 is parallel to the longitudinal axes of the ceiling joists such as 14A, 14B or 15A, 15B, etc. With pole 19 and support hanger 16 thus oriented, the end of the pole and support hanger is lifted through the small space between the parallel ceiling joists and raised to a level where the hooked ends 16B and 16C can be rotated over the tops of the ceiling joists without interference. While thus elevated, elongated pole 19 together with the support hanger supported in the end thereof and attached suspension wire 17 are then rotated aproximately 90° so that the plane containing the hooked ends 16B and 16C is at right angles to the longitudinal axes of the ceiling joists. The workman then lowers elongated pole 19 sufficiently to allow the hooked ends to rest over the tops of the ceiling joists in the manner shown in FIG. 2 of the drawings. At this point, the workman then tugs down on the elongated pole 19 with sufficient force to cause the support hanger 16 to be released from its press fit in keyway 22 thereby leaving the support hanger 16 and attached suspension wire 17 hanging from the ceiling joist at a desired point along the length of the ceiling joist without ever requiring that the workman climb up to the ceiling joist to accomplish this end.

The above-described procedure is then carried out at a number of desired points along the lengths of adjacent ceiling joist where it is desired that suspension wires 17 be installed. To complete the ceiling, the lower ends of the suspension wire 17 are tied through openings in the base of the inverted T-shaped support members 18 to provide a network of supporting members 18 that will support the ceiling panels 10 in place at a desired height above the floor of the building.

In preferred forms of the invention, the new and improved support hangers 16 preferably are formed from heavy gauge galvanized wire such a #12 galvanized wire or the like and may be preshaped by bending in a die. Further, while the support members have been described as U-shaped, it is believed obvious that in the place of gradual U the U could have a square bottom end, or alternatively could have a W-shape with the free ends of the W being hooked over, etc. Other configurations will suggest themselves to those skilled in the art in the light of the present disclosure. What is important is that sufficient hooking capability be provided to the support hangers to assure that they will not readily drop off the ceiling joists. This is believed apparent from FIG. 5 of the drawings, which shows the new and improved support hanger used in conjunction with ceiling joists comprised by L-shaped beams 23A and 23B having an L-shaped cross sectional configuration where such L-shaped beams are employed in place of the circular rods shown in FIG. 1. With either type of construction, twisting or working of the support hanger will not cause the hangers to fall off thereby releasing their support of the suspended ceiling.

In addition, the above description illustrates the novel method of suspended ceiling construction used in conjunction with a telescoping pole 19. In fact any elongated pole such as electrical conduit can be used provided of course that the pole is of sufficient length to allow the end of the pole together with inserted U-shaped support hangers to be lifted above the ceiling joists and twisted so as to orient the hooked ends of the support member over the ceiling joists. If in fact an electrical conduit is employed for this purpose, it would be provided with a plug such as 21 having a keyway 22 in the end thereof for closing the one end of the conduit and providing a press fit receptacle for supporting the U-shaped bend portion of the support hanger in the manner described.

From the foregoing description, it will be appreciated that the invention provides a new and improved support hanger for installing suspension wires for supporting suspended ceilings and the like from the roof joists of buildings and a new and improved method of installation of suspended ceilings using such support hangers. The provision of the novel support hangers together with an elongated pole having a plugged end with a keyway formed therein for receiving and gripping a support hanger while it is raised to a desired elevational position, rotated and then deposited upon the ceiling joist comprises a novel installation kit for use in carrying out the method of the invention.

INDUSTRIAL APPLICATION

The industrial application of the invention is in the erection of suspended ceilings in commercial and industrial buildings wherein it is desired to erect ceilings in certain areas of the building by suspending ceilings from parallel extending ceiling joists supporting the roof structure of the building.

Having described one embodiment of a new and improved support hanger for suspended ceilings and method of installation in accordance with the invention, it is believed obvious that other modifications and variations of the invention will be suggested to those skilled in the art in the light of the above teachings. It is therefore to be understood that the changes may be made in the particular embodiment of the invention described which are within the full intended scope of the invention as defined by the appended claims.

What is claimed is:

1. A new and improved method for installation of suspended ceilings between a set of parallel ceiling joists employing an improved support hanger; the support hanger having a generally U-shaped configuration that provides a generally U-shaped bend portion with the free ends thereof bent outwardly away from each other and downwardly toward the bottom of the U-shaped bend portion to form two hooked ends which open downwardly and lie in substantially the same plane with the U-shaped bend portion; the method comprising tying a suspension wire to be supported in space between the set of parallel ceiling joists near the U-shaped bend portion of the support hanger, inserting the U-shaped bend portion of the support hanger together with attached suspension wire in a keyway formed in the end of an elongated pole of sufficient length to reach between the parallel ceiling joists from the floor, the keyway in the end of the pole providing a press fit for the support hanger U-shaped bend portion and preventing relative rotation between the inserted support hanger and the pole, raising the end of the pole with the inserted support hanger and attached suspension wire through the space between the set of parallel ceiling joists by orienting the pole and support hanger insert so that the plane containing the downwardly directed hooked ends is parallel to the axes of the set of parallel ceiling joists, raising the end of the pole together with the inserted support hanger sufficiently above the level of the parallel ceiling joists so that the support hanger hooked ends will clear the tops of the ceiling joists, rotating the pole and inserted support hanger relative to the set of ceiling joists so that the plane containing the downwardly directed hooked ends is substantially at right angles with respect to the longitudinal axes of the set of parallel ceiling joists, lowering the end of the pole with the inserted support hanger thus oriented to cause the downwardly directed hooked ends of the support hanger to engage the tops of the ceiling joists and tugging the end of the pole downwardly with sufficient force to release the support hanger from its press fit in the keyway and leave it suspended together with its attached suspension wire at a desired point in space along the length of the ceiling joists.

2. A method for installing suspension ceilings according to claim 1 wherein the support hanger is comprised of heavy gauge galvanized wire bent to provide the generally U-shaped configuration with downwardly directed hooked end portions.

3. A method for installing suspension ceilings according to claim 1 wherein the elongated pole comprises a length of electrical conduit having a solid plug closing one end thereof with the solid plug having a keyway formed therein for receiving the U-shaped bend portion of the support hanger.

4. A method of installing suspension ceilings according to claim 1 further including installing a plurality of support hangers together with respective attached ceiling suspension wires at a number of points along the same and adjacent sets of parallel ceiling joists, securing ceiling support members to the suspended ends of the ceiling suspension wires at the desired level for the suspended ceiling and supporting ceiling panels within the ceiling support members.

5. A method for installing suspension ceilings according to claim 4 wherein the support hanger is comprised of heavy gauge galvanized wire bent to provide the generally U-shaped configuration with downwardly directed hooked end portions.

6. A method for installing suspension ceilings according to claim 5 wherein the elongated pole comprises a length of electrical conduit having a solid plug closing one end thereof with the solid plug having a keyway formed therein for receiving the U-shaped bend portion of the support hanger.

7. A method for installing suspension ceilings according to claim 1 wherein the elongated pole comprises a telescoping pole which can be telescoped out to reach different height ceiling joists and has a solid plug closing the end of the outermost telescoping section with the solid plug having a keyway formed therein for receiving the U-shaped bend portion of the support hanger.

8. A method for installing suspension ceilings according to claim 5 wherein the elongated pole comprises a telescoping pole which can be telescoped out to reach different height ceiling joists and has a solid plug closing the end of the outermost telescoping section with the solid plug having a keyway formed therein for receiving the U-shaped bend portion of the support hanger.

9. A new and improved suspended ceiling installed according to the method of claim 1.

10. A new and improved suspended ceiling installed according to the method of claim 4.

11. A new and improved suspended ceiling installed according to the method of claim 5.

12. A new and improved hanging ceiling support hanger kit for suspension ceilings and the like; said support hanger kit comprising a support hanger having a generally U-shaped configuration that provides a generally U-shaped bend portion with the free ends thereof bent outwardly away from each other and downwardly toward the bottom of the U-shaped bend portion to form two hooked ends which open downwardly and lie in substantially the same plane with the U-shaped bend portion; and an elongated pole having one closed end with a keyway formed therein and of sufficient length to reach ceiling joists from the floor of a building space, and the keyway in the end of the pole providing a press fit for the support hanger U-shaped bend portion and preventing relative rotation between the inserted support hanger and the pole.

13. A new and improved hanging ceiling support hanger kit according to claim 12 wherein the support hanger is comprised of heavy gauge galvanized wire bent to provide the generally U-shaped configuration with downwardly directed hooked end portions.

14. A new and improved hanging ceiling support hanger kit according to claim 12 wherein the elongated pole comprises a length of electrical conduit having a solid plug closing one end thereof with the solid plug having a keyway formed therein for receiving the U-shaped bend portion of the support hanger.

15. A new and improved hanging ceiling support hanger kit according to claim 13 wherein the elongated pole comprises a length of electrical conduit having a solid plug closing one end thereof with the solid plug having a keyway formed therein for receiving the U-shaped bend portion of the support hanger.

16. A new and improved hanging ceiling support hanger kit according to claim 12 wherein the elongated pole comprises a telescoping pole which can be telescoped out to reach different height ceiling joists and has a solid plug closing the end of the outermost telescoping section with the solid plug having a keyway formed therein for receiving the U-shaped bend portion of the support hanger.

17. A new and improved hanging ceiling support hanger kit according to claim 13 wherein the elongated pole comprises a telescoping pole which can be telescoped out to reach different height ceiling joists and has a solid plug closing the end of the outermost telescoping section with the solid plug having a keyway formed therein for receiving the U-shaped bend portion of the support hanger.

18. A new and improved hanging ceiling support hanger for suspension ceilings and the like; said support hanger comprising a support hanger having a generally U-shaped configuration that provides a generally U-shaped bend portion with the free ends thereof bent outwardly away from each other and downwardly toward the bottom of the U-shaped bend portion to form two hooked ends which open downwardly and lie in substantially the same plane with the U-shaped bend portion and wherein the support hanger is comprised of heavy gauge galvanized wire bent to provide the generally U-shaped configuration with downwardly directed hooked end portions.

* * * * *